US007018972B2

(12) United States Patent
Akkermans et al.

(10) Patent No.: US 7,018,972 B2
(45) Date of Patent: Mar. 28, 2006

(54) PROCESS FOR THE PRODUCTION OF DETERGENT GRANULES

(75) Inventors: Johannes Hendrikus Maria Akkermans, Vlaardingen (NL); Roland Wilhemus Johannes van Pomeren, Boksburg (NL); Remy Antal Verburgh, Vlaardingen (NL)

(73) Assignee: Unilever Home and Personal Care USA a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/278,408

(22) Filed: Oct. 23, 2002

(65) Prior Publication Data

US 2003/0096727 A1 May 22, 2003

(30) Foreign Application Priority Data

Oct. 25, 2001 (GB) ..... 0125653
Jan. 28, 2002 (GB) ..... 0201907

(51) Int. Cl.
*C11D 11/00* (2006.01)

(52) U.S. Cl. ..... 510/444; 510/507; 510/509; 264/117; 264/140; 23/313 R; 23/313 FB

(58) Field of Classification Search ..... 510/444, 510/507, 509; 264/117, 140; 23/313 R, 23/313 FB See application file for complete search history.

(56) References Cited

U.S. PATENT DOCUMENTS

| | | | | | |
|---|---|---|---|---|---|
| 4,721,633 | A | | 1/1988 | Baldassin | 427/212 |
| 4,869,843 | A | | 9/1989 | Saito et al. | 252/135 |
| 5,565,137 | A | * | 10/1996 | Capeci | 510/276 |
| 5,616,550 | A | * | 4/1997 | Kruse et al. | 510/444 |
| 5,736,502 | A | * | 4/1998 | Wilkinson | 510/444 |
| 5,929,021 | A | | 7/1999 | Dhanuka et al. | 510/444 |
| 5,998,357 | A | | 12/1999 | Appel et al. | 510/444 |
| 6,077,820 | A | * | 6/2000 | Dhanuka et al. | 510/444 |
| 6,093,690 | A | | 7/2000 | Chapman | 510/444 |
| 6,133,223 | A | * | 10/2000 | Sampaio et al. | 510/444 |
| 6,258,773 | B1 | | 7/2001 | Mort, III et al. | 510/444 |
| 6,262,010 | B1 | * | 7/2001 | Emery et al. | 510/446 |
| 6,274,544 | B1 | * | 8/2001 | Akkermans et al. | 510/444 |
| 6,391,846 | B1 | * | 5/2002 | Berthod et al. | 510/507 |
| 6,429,184 | B1 | * | 8/2002 | Akkermans et al. | 510/444 |
| 6,455,490 | B1 | * | 9/2002 | Berthod et al. | 510/507 |
| 6,573,231 | B1 | * | 6/2003 | Bakker et al. | 510/438 |
| 6,576,605 | B1 | * | 6/2003 | Daiki | 510/444 |

FOREIGN PATENT DOCUMENTS

| | | |
|---|---|---|
| EP | 360 330 | 3/1990 |
| EP | 384 070 | 8/1990 |
| EP | 390 251 | 10/1990 |
| EP | 643 129 | 3/1995 |
| GB | 2 199 338 | 7/1988 |
| GB | 2 221 695 | 2/1990 |
| JP | 61/069897 | 4/1986 |
| WO | 96/25482 | 8/1996 |
| WO | 96/34082 | 10/1996 |
| WO | 97/22685 | 6/1997 |
| WO | 97/32002 | 9/1997 |
| WO | 98/16615 | 4/1998 |
| WO | 98/58046 | 12/1998 |
| WO | 98/58047 | 12/1998 |
| WO | 98/58048 | 12/1998 |
| WO | 99/64558 | 12/1999 |
| WO | 00/44874 | 8/2000 |
| WO | 00/77140 | 12/2000 |
| WO | 01/40428 | 6/2001 |

OTHER PUBLICATIONS

Co-pending application. Applicant: Akkermans et al., U.S. Appl. No. 10/278,409: filed: Oct. 23, 2002.

* cited by examiner

*Primary Examiner*—Lorna M. Douyon
(74) *Attorney, Agent, or Firm*—Rimma Mitelman

(57) ABSTRACT

A process for the preparation of detergent granules, the process comprising:

(i) a first step of admixing in a mechanical granulator, a solid component and a first liquid binder, to produce a powder; and (ii) a second step of admixing in a low shear granulator, the powder produced in step (i), and a second liquid binder, to produce the detergent granules;

the second liquid binder having a different composition from the first liquid binder and the weight ratio of the first liquid binder to the second liquid binder being from 15:1 to 1:1, preferably from 10:1 to 1:1, more preferably from 5:1 to 1:1, most preferably from 3:1 to 2:1.

18 Claims, No Drawings

PROCESS FOR THE PRODUCTION OF DETERGENT GRANULES

TECHNICAL FIELD

The present invention relates to a process for the production of detergent compositions by a granulation process in which solids and a liquid binder are mixed in a mechanical granulator and then further liquid binder is sprayed-on in a low shear granulator such as a fluid bed.

BACKGROUND OF THE INVENTION

Traditionally, detergent powders were produced by spray drying. However, the spray drying process is both capital and energy intensive and the products were quite bulky, having a relatively low bulk density.

The desire for powders with higher bulk densities led to the development of processes which employ mainly mixing, without the use of spray drying. These mixing techniques offer great flexibility in producing powders of various different compositions from a single plant, by post-dosing various components after an initial granulation stage. The resultant powders have fairly high bulk densities, which is desirable for some product forms. However, many of these non-spray drying techniques are unsuitable for production of powders over a wide bulk density range and in particular, for the production of lower bulk density powders.

One kind of process, which does not involve spray-drying, and which is capable of producing medium bulk densities between those of spray dried and other non-spray dried powders, involves use of a low shear granulator, usually a fluidised bed apparatus. Although fluidised bed granulation processes per se can give good control of bulk density, there can still be problems with poor dispensing of the resultant product.

EP-A-360 330 discloses a process in which a spray dried base powder is sprayed in the low shear mixer with a liquid binder comprising a fatty acid and a nonionic surfactant to improve dispensing properties of the final product.

However, we found that for granulated powders such a coating does not reliably provide adequate dispensing behaviour.

For overall powder quality it is important to find the right balance between fast dispensing and fast enough dissolution. The techniques used to improve dispensing should not deteriorate solubility beyond unacceptable limits. At the same time, the dispensing improvement of the powder should be robust, e.g. during handling and transportation of the product, where particle breakdown may occur.

We have now found that dispensing properties of non-spray dried materials are significantly improved in a granulation method in which solids are granulated in a two-stage process in which the second stage is effected in a low shear granulator such as of fluid bed type and a liquid binder is applied in both stages.

DEFINITION OF THE INVENTION

The present invention provides a process for the preparation of detergent granules, the process comprising:

(i) a first step of admixing in a mechanical granulator (as hereinafter defined), a solid component and a first liquid binder, to produce a powder; and (ii) a second step of admixing in a low shear granulator, the powder produced in step (i), and a second liquid binder, to produce the said detergent granules;

said second liquid binder having a different composition from said first liquid binder and the weight ratio of the first liquid binder to the second liquid binder being from 15:1 to 1:1, preferably from 10:1 to 1:1, more preferably from 5:1 to 1:1, most preferably from 3:1 to 2:1.

DETAILED DESCRIPTION OF THE INVENTION

The process of the present invention may be carried out in either batch or continuous mode of operation as desired.

The Liquid Binders

The term "liquid binder" refers to a material or materials that are liquids or are at least pumpable respectively at the temperature at which they enter the mechanical granulator in step (i), or the low shear granulator of step (ii). In the case of step (i), that temperature is preferably at least 80° C. and is more preferably no higher than 120 ° C. In the case of step (ii), that temperature is preferably, from 40° C. to 120° C. more preferably from 60° C. to 100° C.

Preferably, the first liquid binder contains anionic surfactant which may be in neutralised form and/or in acid form to be neutralised by an alkaline neutralising agent forming at least part of the solid component. The amount of anionic surfactant in the first binder preferably constitutes from 25% to 75% by weight of the first binder.

Nonionic surfactant and soap and/or fatty acid are preferably incorporated in the first or second liquid binders, most preferably in both.

Any fatty acid is intended to be neutralised by an alkaline neutralising agent forming at least part of other materials in the process. Neutralising agent is preferably, at least in part, incorporated in the powder obtained during step (i).

The first and second liquid binders must have different compositions. Preferably, the weight ratio of synthetic non-soap anionic surfactant to nonionic surfactant in the first liquid is greater than 1:4, more preferably from 1:2 to 3:1, still more preferably from 1:1 to 2:1. Preferably, weight ratio of synthetic non-soap anionic surfactant to nonionic surfactant in the second liquid binder and from 0:1 to 1:4.

Most, preferably substantially all, of the first liquid binder contains soap and/or fatty acid, as well as nonionic surfactant. Again, any fatty acid is preferably to be neutralised in situ, during granulation.

When nonionic surfactant and fatty acid and/or soap are used in both the first and second liquid binders, the component comprising those materials may be the same in both binders (i.e. they are the same materials in the same weight ratios in both cases). Preferably, the weight ratio of nonionic surfactant to fatty acid and/or soap is the same as, or larger than, the ratio of those components in the second binder.

To obtain the right balance between robust dispensing and solubility, it is important that the night balance between first and second binder is used. If a too low amount of the second binder is used, the granules are only partially granulated with the second binder, which can result in a less than optimal dispensing improvement, especially if breakdown of the particles occurs during handling. On the other hand, a too large amount of second binder will result in an unacceptable deterioration in dissolution. Therefore, preferably, the weight ratio of the first liquid binder to the second liquid binder is from 15:1 to 1:1, preferably from 10:1 to 1:1, still more preferably 5:1 to 1:1, most preferably from 3:1 to 2:1. Alternatively, the second liquid binder may constitute from 10% to 50%, more preferably from 15% to 30% by weight of the first liquid binder plus second liquid binder. Preferably also, the weight ratio of the liquid nonionic surfactant to the soap or fatty acid in the second liquid binders is at least 1:1, preferably at least 2:1, and preferably no more than 5;1.

As already mentioned, any anionic surfactant may be formed in situ in the relevant granulator(s) by reaction between an acid precursor of the anionic surfactant and a neutralising agent such as an alkali metal, preferably sodium, alkali such as the carbonate, bicarbonate or hydroxide or a mixture thereof. However, preferably the anionic surfactant is introduced preneutralised, most preferably as a blend with the other components of the liquid binder.

Further, as previously indicated, any soap of the liquid binder is preferably formed by in situ neutralisation of a fatty acid with an alkaline agent such as an alkali metal carbonate or hydroxide. However, it may also be introduced as the soap per se, in a blend with the other liquid binder components.

Typical chain lengths of suitable fatty acids and soaps are from 10 to 22 carbon atoms.

The total water in all components applied in step (1) plus step (ii) preferably does not exceed 25 wt % of the total liquid binder, but more preferably no more than 10 wt %. If the water level is above 10%, preferably drying is carried out in step (ii) or in a subsequent stage, e.g. using heated air. The water may be added in amounts of 0.5 to 10 wt % by weight of the final detergent composition. Most preferably though, the water content of all materials dosed in steps (i) and (ii) is less than 10% by weight of the total of those materials.

The Solid Component

Preferably, at least some of the solid component must be non-spray dried material. More preferably, more than 50% by weight still more preferably, more than 75% by weight of the solid component is non-spray dried.

Preferably, the solid component comprises one or more detergency builders and/or water-soluble salts, for example water soluble inorganic salts. Included in the latter are optional alkaline agents which may be used to neturalise fatty acid in situ, as described above.

Preferably, the weight ratio of liquid binder to solid component in step (i) is from 1:9 to 2:5, preferably from 1:7.to 1:3.

The inclusion of aluminosilicate can also improve the flow behaviour of granules, although it can negatively affect the dispensing behaviour. Thus, it is preferred for the use of a flow aid to be avoided or kept at minimal levels, e.g. less than 2% by weight of the granules. However, this does not preclude use of higher amounts of aluminosilicate within the granular structure (flow aids substantially are used to coat the exterior of the granules).

The principle of adding a "layering agent" (usually, an aluminosilicate) in the final stage of non-spray drying mechanical granulating process for detergents is well known, for example as described in "Surfactants in Consumer Products", Springer Verlag, 1987, pp 411–413.

Aluminosilicates, whether crystalline and/or amorphous may suitably be present in the final granules, a total amount from 10 to 60 wt % and preferably an amount of from 15 to 50 wt % of the granulated detergent product. Optionally, up to 90%, more preferably up to 70% of this aluminosilicate may be replaced by one or more other insoluble absorbent powder materials, e.g. selected from clay, silica, calcite and insoluble silicate salts such as magnesium silicate. The zeolite used in most commercial particulate detergent compositions is zeolite A. Advantageously, however, maximum aluminium zeolite P (zeolite MAP) described and claimed in EP-A-384 070 may be used. Zeolite MAP is an alkali metal aluminosilicate of the P type having a silicon to aluminium ratio not exceeding 1.33, preferably not exceeding 1.5, and more preferably not exceeding 1.07.

In general, any water soluble salt forming all or part of the solid component may comprise one or more water soluble inorganic and/or organic salt compounds. These may be chosen from inorganic water soluble salts as inorganic alkaline agents, e.g., selected from alkali metal hydroxides and silicates, alkali metal phosphate builders such as tripolyphosphates, as well as carbonated agents typically selected from one or more materials selected from alkali metal carbonates, sesquicarbonates and bicarbonates, preferably sodium salts thereof, as well as burkeite. Alternatively, or additionally, water soluble organic salts such as alkali metal salts of organic acids such as carboxylic and di- and higher-carboxylic acids, for example acetic acid, citric acid, glutaric acid and succinic acid may be used. Again, sodium salts are preferred.

Suitable non-alkaline, inorganic salts may be selected from alkali metal sulphates, chlorides.

Preferred alkali metal salts are the sodium or potassium salts.

Preferably, no more than 9%, of water soluble salt more preferably no more than 7% by weight based on the weight of the detergent granules is introduced into the granulator of step (i), most preferably 0%.

The total level of such salts in the granules formed at the end of step (ii) is from 7% to 30%, more preferably from 10% to 25% by weight of those granules.

Preferably, the water soluble salt has a $d_{3,2}$ average particle size no more than 90 μm, preferably no more than 80 μm, more preferably no more than 70 μm, still more preferably no more than 60 μm, yet more preferably no more than 50 μm and especially no more than 40 μm. Preferably, the minimum $d_{3,2}$ average particle size of the solid carbonated neutralising agent is 1 μm, more preferably 4 μm, most preferably 10 μm.

By "average $d_{3,2}$ size" is meant the surface weighted mean diameter given by the equation:

$$d_{3,2} = \left[ \sum_{i}^{m} \frac{n_i D_i^3}{\sum_{i}^{m} n_i D_i^2} \right]$$

wherein $n_i$ is the number of particles in size class i $D_i$ is the median diameter value in size class i m is the number of size classes Of course, a given $d_{3,2}$ average particle size may be inherent in a commercially available raw material, or may be achieved by milling a commercial sample. It may also be achieved by mixing two or more raw materials of different morphologies.

The Granulation Apparatus

Step (i) of the invention requires use of a mechanical granulator. Preferably, this is of a type having moving impellers. However, as used herein, the term "mechanical" granulator means a granulator which does not consist solely of a spray drying tower but comprises a low-shear or high shear granulator which mixes materials, e.g. using impellers or a tumbling or gasification method. It may comprise a combination of such machines. Further step (i) does not preclude some or all of the solid component comprising a spray dried material.

Suitable mechanical granulators include a high speed mixer/granulator such as a Lodige®CB machine or a moderate-speed mixer such as a Lodige®KM machine.

Other suitable equipment includes Drais®T160 series manufactured by Drais Werke GmbH, Germany; the Littleford mixer with internal chopping blades and turbine-type miller mixer having several blades on an axis of rotation. A low- or high-shear mixer granulator often has a stirring action and/or a cutting action which are operated independently of one another. Preferred types of low- or high-shear mixer granulators are mixers of the Fukae®FS-G series; Diosna®V series ex Dierks & Sohne, Germany; Pharma Matrix®ex. T.K. Fielder Ltd, England. Other mixers which are suitable for use in the process of the invention are Fuji®VG-C series ex Fuji Sangyo Co., Japan; the Roto®ex Zanchetta & Co. sri, Italy and Schugi R Flexomix granulator.

Yet another suitable mixer is the Lodige (Trade Mark) FM series (ploughshare mixers) batch mixer ex Morton Machine Col Ltd., Scotland.

Step (ii) of the process of the present invention requires use of a low shear granulator.

A preferred low shear granulator is one of the gas fluidisation type, which comprises a fluidisation zone in which the liquid binder is sprayed into or onto the solid neutralising agent. However, a low shear bowl mixer/granulator can also be used. When the low shear granulator is of the gas fluidisation kind it may sometimes be preferable to use equipment of the kind provided with a vibrating bed.

If the low-shear granulator is of the gas fluidisation kind, then the liquid binder can be sprayed from above and/or below and/or within the midst of the fluidised material comprising the solid neutralising agent.

If a gas fluidisation granulator is used as the low-shear granulator, then preferably it is operated at a superficial air velocity of about 0.1–2.0 ms⁻either under positive or negative relative pressure and with an air inlet temperature ranging from −10° C. or 5° C. up to 80° C., or in some cases, up to 200° C. An operational temperature inside the bed of from ambient temperature to 60° C. is typical. Depending on the process, it may be advantageous to vary the temperature (upwardly and/or downwards, during at least part of the process).

A low-shear granulator used in the process of the present invention may be adapted to recycle "fines", i.e. powdered or part-granular material of vary small particle size, so that they are returned to the input of the low shear granulator and/or input of any pre-mixer/granulator. Preferably the fine particulates are elutriated material, e.g. they are present in the air leaving a gas fluidisation chamber.

It is preferred to operate the fluidised bed granulator such that solid material is contacted with a spray of the liquid components to meet the requirement that the excess velocity ($U_e$) of fluidisation gas relative to the mass or volume flux of the spray ($q_{mliq}$ or $q_{vliq}$) when determined at the normalised nozzle-to-bed distance ($D_o$) is set so that the flux number ($FN_m$ or $FN_v$) as determined by $$FN_{in} = \log_{10}\left[\frac{\rho_p U_c}{q_{mliq}}\right] \text{ OR } FN_v = \log_{10}\left[\frac{U_e}{q_{vliq}}\right]$$

(where $p_p$ is the particle density) is at a critical value of at least 2 for at least 30% of the process.

It is also preferred that $d_{3,2}$ average droplet diameter of the liquid binder dosed in step (ii) is not greater than ten times the $d_{3,2}$ average particle diameter of that fraction of the solids which has a $d_{3,2}$ particle diameter of from 20 μm to 200 μm, provided that if more than 90% by weight of the solid starting material has a $d_{3,2}$ average particle diameter less than 20 μm then the $d_{3,2}$ average particle diameter of the total solid starting materials shall be taken to be 20 μm. If more than 90% by weight of the solid starting material has a $d_{3,2}$ average particle diameter greater than 200 μm than the $d_{3,2}$ average particle diameter of the total starting solid material shall be taken to be 200 μm.

Preferably, the first liquid binder constitutes from 30% to 90%, more preferably from 60% to 80% by weight of total weight of first liquid binder plus second liquid binder. Fines elutriated in the fluid bed (step ii) can be recycled into the process via conventional methods. The fine material can be recycled into step (i) or (ii). It is preferred that material is recycled back into step (ii) (to avoid high salt loadings in step (i)).

Compositional Features

The invention also encompasses both granules and detergent compositions obtainable by a process according to the present invention.

Granules made by a process according to the present invention optionally contain one or more additional components in addition to those arising from processing of the liquid binder and solid component.

In addition, granules made by a process according to the present invention may be incorporated in a detergent composition comprising one or more post dosed materials. Solid post-dosed materials comprise powders, other granules (whether or not made by a process other than the invention) and mixtures thereof. Granules made by the process of the invention and post-dosed solids can simply be admixed or subject to further granulation by any suitable process. Post-dosed liquids are conveniently sprayed onto the granules themselves and/or onto (if present) any post-dosed solids.

Other optional components dosed in step (i) preferably constitute less than 5 wt %, more preferably less than 2 wt %, of the total of all materials dosed In step (i). Any optional components dosed in step (ii) preferably constitute less than 2%, more preferably less than 1% by weight of all materials dosed in step (ii), including the powder from step (i).

As already explained, the first and second liquid binders preferably comprise anionic surfactant, as well as the essential nonionic surfactant and soap. The weight ratio of all anionic surfactant(s) to nonionic surfactants, will normally be from 20:1 to 1:20. However, this ratio may be, for example, 15:1 or less, 10:1 or less, or 5:1 or less of anionic surfactant(s) to nonionic surfactants(s). On the other hand, the nonionic may be the major component so that the ratio is 1:5 or more, 1:10 or more, or 1:15 or more of anionic surfactant(s) to nonionic surfactants(s). Ratios in the range from 5:1 to 1:5 of anionic surfactant(s) to nonionic surfactants(s) are also possible.

The anionic surfactant may actually comprise one or more different anionic surfactant compounds. The most preferred of these is alkyl benzene sulphonic acid, for example having from 10 to 14 carbon atoms on average, in the alkyl chain thereof Other suitable anionic surfactants comprise primary alkyl sulphates and alkyl olefin sulphonates, as well as alkyl ether sulphates. In all cases, these materials preferably have on average in the aliphatic moiety thereof, from 10 to 18 carbon atoms.

Preferred nonionic surfactants are ethoxylated alcohols, e.g. having an alkyl chain from 8 to 12 carbon atoms and an average of 3 to 9 ethylene oxide groups.

Optionally, a flow aid may be introduced with the starting materials in step (i). However, it is preferred that the flow aid be added after the start of step (ii), in order to obtain to improved powder properties. Suitable flow aids include crystalline or amorphous alkali metal silicates, Dicamol, calcite, diatomaceous earth, silica, for example precipitated silica, chlorides such as sodium chloride, sulphates such as magnesium and sodium sulphate, carbonates such as calcium carbonate and phosphates such as sodium tripolyphosphate. Mixtures of these materials may be employed as desired. As used herein, for materials added during step (ii), the term "flow aid" specifically excludes aluminosilicates such as zeolites.

In addition cationic, zwitterionic, amphoteric or semipolar surfactants and mixtures thereof may be added at a suitable time. In general, suitable surfactants include those generally described in "Surface active agents and detergents" Vol. 1 by Schwartz and Perry. If desired, soap derived from saturated or unsaturated fatty acids having, for example, $C_{10}$ to $C_{18}$ carbon atoms may also be present.

The total detergent active in the granules resulting from step (ii) is suitably present at a level of 5 to 70wt %, preferably 10 to 50wt % of the final granulated detergent product.

A complete detergent composition often contains a detergency builder. Aluminosilicate is an essential builder component in granules made by the process of the present invention. Such a builder or its precursor may be introduced with a neutralising agent used to neutralise fatty acid and/or acid anionic surfactant precursor. Additionally or alternatively, the builder may constitute a separate component not utilised for the neutralising function. However, as already explained, some alkaline inorganic salts by themselves, or in the presence of a co-agent, can act as builders. Sodium carbonate is a typical example. Therefore, such materials may be considered as inorganic salts as hereinbefore defined.

Generally speaking, the total amount of detergency builder in the granular detergent product resulting from step (ii) is suitably from 10 to 80 wt %, preferably 15 to 65 wt % and more preferably 15 to 50 wt %.

Inorganic phosphate builders, for example, sodium orthophosphate, pyrophosphate and tripolyphosphate, may also be present.

Organic builders that may be present include polycarboxylate polymers such a polyacrylates, acrylic/maleic copolymers, and acrylic phosphinates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive, Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Citrates can also be used at lower levels (e.g. 0.1 to 5 wt %) for other purposes. The builder is preferably present in alkali metal salt, especially sodium salt form.

Detergent compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Granules obtained by the process of the present invention suitably have a low bulk density in the range 400 to 900 g/l, or 500 to 800 g/l, for example, in the proximity of 650 g/l.

It is also preferred that the powder produced at the end of step (i) has a d50 average particle size of from 150 μm to 450 μm.

The granulation process results in enlargement of the particle size of the solid starting materials in the formulation of the final granules. Thus, it is preferred that the granules produced in step (ii) have a d50 average particle size of at least 1.5 ×the d50 average particle size of the powder produced at the end of step (i).

As used herein, the term d50 average particle size (or diameter) means the value whereby 50% by weight of the particles have a particle size above that value and 50% below.

The composition may also comprise a post-dosed particulate filler which suitably comprises an inorganic salt, for example sodium sulphate and sodium chloride. The filler may be present at a level of 5 to 60% by weight of the composition.

A fully formulated detergent composition incorporating granules produced according to the invention might for example comprise the detergent active and builder and optionally one of more of a flow aid, a filler and other minor ingredients such as colour, perfume, fluorescer, bleaches and enzymes.

The invention will now be illustrated by the following non-limiting examples.

EXAMPLES

Dispensing Test Protocol

For the purposes of the present invention, dispensing was assessed by means of a standard procedure using a test rig based on the main wash compartment of the dispenser drawer of the Philips (Trade Mark) AFG washing machine. This drawer design provides an especially stringent test of dispensing characteristics especially when used under conditions of low temperature, low water pressure and low rate of water flow.

The drawer is of generally cuboidal shape and consists of three larger compartments, plus a small front compartment and a separate compartment for fabric conditioner.

Only the middle (main wash) compartment is used in the test, the other compartments play no part in the test.

In the plate above the drawer an area has been cut away without affecting the spray holes, to allow visual inspection of the dispensing process.

In the test, a 100 g dose of powder is placed in a heap at the front end of the main compartment of the drawer, and subjected to a controlled water fill rate of 5 litres/minute at 10° C. The water enters through 2 mm diameter holes in a plate above the drawer: some water enters the front compartment and therefore does not reach the powder. Powder and water in principle leave the drawer at the rear end which is open.

The dispensing of the powder is followed visually and the time at which all the powder is dispensed is recorded. After the maximum dispensing time (in most cases set at 1 minute) the flow of water is ceased, and any powder remaining is then collected and dried at 95° C. to constant weight. The dry weight of powder recovered from the dispenser drawer, in grams, represents the weight percentage of powder not dispensed into the machine (the residue). Every result is the average of two duplicate measurements. Total dispensing is followed up to 60 seconds.

Insolubles Test Protocol

For the purposes of the present invention, insolubles were determined as a measure for the dissolution quality. Insolubles were assessed by means of the following standard procedure.

10 grams of a powder sample is added to 500 ml of water at 18° FH and 20° C., stirred with a magnetic stirrer in a 1 litre beaker while maintaining a 4 cm vortex. After 2 minutes, the solution is poured over a 125 μm pre-weighed sieve. The sieve is then dried in an oven at 100° C. for 1 hour. The insolubles level is expressed as the percentage of residue:

If: m=Weight of empty sieve m1=Weight of dried sieve plus residue w=Sample weight (10 grams)

Then:

$$\text{insoluble level (\%)}=[(m1-m)\times 100]/w$$

Example 1

A powdery pre-mix with the following composition was made by granulation in a Lödige recycler:

| | |
|---|---|
| NaLAS | 13.01 |
| Nonionic 7EO (Lutensol AO7) | 10.42 |
| Soap (neutralised Pristerene 4916) | 1.73 |
| Zeolite A24 | 46.98 |
| Light soda ash | 15.89 |
| Sodium silicate (Pyramid P70) | 4.01 |
| Moisture, NDOM etc. | 7.95 |

NDOM = non-detergent organic matter.

The NaLAS, nonionic and soap were added as a pre-neutralised structured blend at 80° C. 13.5 kg of this powder was put into a Vometec fluid bed.

In a first experiment this powder was granulated in the fluid bed with 1.2 kg of a nonionic/fatty acid mixture (weight ratio 3/1) to form powder 1, (This is 25% by weight of the total of the first and second liquid binder and 8% by weight of the full formulation)

In a second experiment this powder was granulated with 2.2 kg of the same structured blend as used in the pre-mix (LAS/NI/soap) to form powder A (comparative).

In a third experiment a repeat of powder A was coated with a second binder of a nonionic fatty acid mixture (weight ratio 3/1) to form comparative powder B. The weight ratio of second liquid binder to first was 15.67:1 and therefore, outside the scope of the invention.

The powders were subsequently dispensed and the insolubles level was measured, yielding the following results:

| Powder | Granulation binder | Dispensing time | Insolubles [wt %] | Particle size (d50) [μm] |
|---|---|---|---|---|
| 1 (invention) | Nonionic/fatty acid (3/1) | 17 sec | 6.7 | 595 |
| A (comparative) | Na-LAS/NI/soap | 49 sec | 10.9 | 810 |
| B (comparative) | Nonionic/Fatty acid (3/1) | 27 sec | 9.8 | 820 |

The d50 average particle size of the premix used for these powders was 343 microns. The d50 average particle size of the examples after fluid bed granulation is around 600–800 micron which clearly shows that granulation has occurred rather than coating—(size enlargement a factor of from 1.7 to 2.4). These examples show that the powder that is granulated with nonionic and fatty acid exhibits the best dispensing (granulation demonstrated by the particle size increase from 343 to 595). The coated product dispenses better than the non coated, but not as good as the invention product (coating demonstrated by the lack of particle size increase, 810 to 820).

Examples 2–4

In the same way as powder 1 was produced, additional powders were prepared using different nonionic/fatty acid ratios in the second granulation step. In all these cases, dispensing times were very fast.

| Powder | NI/FA ratio used in second step | Dispensing time | Insolubles [wt %] | Particle size (d50) [μm] |
|---|---|---|---|---|
| 2 (invention) | 1/1 | 15 sec | 13.0 | 668 |
| 3 (invention) | 2/1 | 19 sec | 5.9 | 645 |
| 4 (invention) | 3/1 | 14 sec | 5.8 | 579 |

The d50 average particle size of the powdery pre-mix was 343 microns, which shows that real agglomeration has occurred rather than coating (size enlargement factor of from 1.7 to 1.9). As can be seen, The ratio of nonionic and fatty acid should preferably be larger than 1 to obtain good solubility.

Examples 5 and 6

Powdery pre-mixes with the following compositions were made by granulation in a Lodige recycler:

| Ingredients [wt %] | Premix I | Premix II |
|---|---|---|
| NaLAS | 16.26 | 17.16 |
| Nonionic 7EO | 12.98 | 7.77 |
| Soap | 2.16 | 1.94 |
| Zeolite MAP (anhydrous) | 58.70 | 45.20 |
| Carbonate ash light | 0.00 | 15.33 |
| Silicate (ex powder) | 0.01 | 3.86 |
| moisture, NDOM, salts | 9.89 | 8.73 |

Premix I was fed into a fluid bed, together with sodium carbonate (light ash) and these starting materials were granulated with a second liquid binder consisting of non-ionic 7EO and fatty acid in a weight ratio of 3:1 to prepare powder 5. The weight ratio of first binder to second binder was 2.6:1.

Premix II was fed into a fluid bed and was granulated with a second liquid binder consisting of nonionic 7EO and fatty acid in a weight ratio of 3:1 to prepare powder 6. The weight ratio of first binder to second binder was 3:1.

The following compositions were made in this way:

| Ingredients [wt %] | Powder 5 | Powder 6 |
|---|---|---|
| NaLAS | 11.87 | 15.75 |
| Nonionic 7EO | 16.07 | 13.28 |
| Fatty acid | 2.20 | 2.05 |
| Soap | 1.58 | 1.78 |
| Zeolite A24 (anhydrous) | 42.84 | 41.50 |
| Carbonate ash light | 14.57 | 14.08 |
| Silicate (ex powder) | 3.67 | 3.54 |
| moisture, NDOM, salts | 7.22 | 8.00 |

Powder properties including dispensing and insolubles were the following:

| Powder | Bulk density [g/l] | Dispensing time [sec] | Insolubles [wt %] | Particle size (d50) [μm] |
|---|---|---|---|---|
| Powder 5 (invention) | 625 | 10 | 5.2 | 516 |
| Powder 6 (invention) | 646 | 10 | 7.4 | 585 |

The invention claimed is:

1. A process for the preparation of detergent granules, the process comprising:

(i) a first step of admixing in a mechanical granulator, a solid component and a first liquid binder, to produce a powder; and (ii) a second step of admixing in a low shear granulator, the powder produced in step (i), and a second liquid binder comprising a liquid nonionic surfactant and also, a soap and/or wherein the weight ratio of the liquid nonionic surfactant to the soap and/or fatty acid is at least 2:1, to produce the detergent granules;

the second liquid binder having a different composition from said first liquid binder and the weight ratio of the first liquid binder to the second liquid binder being from 15:1to 1:1, preferably from 10:1to 1:1, more preferably from 5:1to 1:1, most preferably from 3:1to 2:1.

2. A process according to claim 1, wherein the first or the second binder comprises a synthetic non-soap anionic surfactant.

3. A process according claim 2, wherein the weight ratio of synthetic non-soap anionic surfactant to nonionic surfactant in the first liquid binder is greater than 1:4, preferably from 1:2to 3:1, more preferably from 1:1to 2:1.

4. A process according to claim 2, wherein the weight ratio of synthetic non-soap anionic surfactant to nonionic surfactant in the second liquid binder is from 0:1to 1:4.

5. A process according to claim 1, wherein the weight ratio of the liquid nonionic surfactant to the fatty acid in the second liquid binder is at least 1:1, preferably at least 2:1, and preferably no more than 5:1.

6. A process according to claim 1, wherein the weight ratio of liquid binder to solid component in step (i) is from 1:9to 2:5, preferably from 1:7to 1:3.

7. A process according to claim 1, wherein the total water content of the total of all materials dosed in step (i) or step (ii) is lower than 10% by weight of the total weight of those materials.

8. A process according to claim 1, wherein the powder produced in step (i) has a d50 average particle size of from 150 μm to 450 μm.

9. A process according to claim 1, wherein at least some, preferably more than 50% by weight, more preferably more than 75% by weight of the solid component is non-spray dried material.

10. A process according to claim 1, wherein the granules produced in step (ii) have a d50 average particle size of at least 1.5×the d50 average particle size of the powder produced in step (i).

11. A process according to claim 1, wherein a water soluble salt is introduced into the low shear granulator of step (ii).

12. A process according to claim 11, wherein no more than 9%, preferably no more than 7%, most preferably 0% by weight of water soluble salt, based on the weight of the detergent granules is introduced into the mechanical granulator of step (i).

13. A process according to claim 11, wherein the water soluble salt comprises sodium carbonate.

14. A process according to claim 11, wherein an aluminosilicate is introduced into the mechanical granulator of step (i).

15. A process according to claim 14, wherein in step (ii), no more than 2%, preferably 0% by weight of the aluminosilicate based on the weight of the detergent granules is introduced into the low shear granulator of step (ii).

16. A process according to claim 14, wherein the amount of aluminosilicate in the detergent granules is from 10% to 60%, preferably from 15% to 50% by weight of those granules.

17. A process according to claim 14, wherein up to 90%, preferably up to 70% by weight of the aluminosilicate in the detergent granules is replaced by an insoluble absorbent powder substance.

18. A process according to claim 17, wherein the insoluble absorbent powder substance is selected from clays, silica, calcite and insoluble silicate salts.

* * * * *